US008272628B2

(12) United States Patent
Winnard

(10) Patent No.: US 8,272,628 B2
(45) Date of Patent: Sep. 25, 2012

(54) TOOL HOLDER

(76) Inventor: Stanley D. Winnard, Carrollton, TX (US)

( * ) Notice: Subject to any disclaimer, the term of this patent is extended or adjusted under 35 U.S.C. 154(b) by 776 days.

(21) Appl. No.: 12/391,114

(22) Filed: Feb. 23, 2009

(65) Prior Publication Data

US 2009/0218741 A1 Sep. 3, 2009

Related U.S. Application Data

(60) Provisional application No. 61/030,957, filed on Feb. 23, 2008.

(51) Int. Cl.
*B25B 11/00* (2006.01)

(52) U.S. Cl. ..... 269/8; 269/6

(58) Field of Classification Search ..... 269/8, 3, 269/6, 95

See application file for complete search history.

(56) References Cited

U.S. PATENT DOCUMENTS

| | | | | | |
|---|---|---|---|---|---|
| 4,591,817 | A * | 5/1986 | Miller | 335/285 |
| 4,621,738 | A * | 11/1986 | DeLucchi | 211/70.6 |
| 4,802,580 | A * | 2/1989 | Andersen | 206/378 |
| 5,343,181 | A * | 8/1994 | Negus | 335/285 |
| 5,669,516 | A * | 9/1997 | Horn | 211/70.6 |
| 5,725,096 | A * | 3/1998 | Winnard | 206/350 |
| 6,702,112 | B1 * | 3/2004 | Henderson | 206/350 |

* cited by examiner

*Primary Examiner* — Lee D Wilson

(57) ABSTRACT

The present invention includes an apparatus and method for restraining a tool that a base having a plurality of spaced apart body apertures of a size and shape for accommodating at least one surface of a tool, said apertures organized in an array according to an outline of at least one surface of each said tool and one or more spacers positioned between the apertures, wherein at least every other spacer comprises a magnet for holding a tool within the aperture.

20 Claims, 2 Drawing Sheets

TOOL HOLDER

CROSS-REFERENCE TO RELATED APPLICATIONS

This application claims priority to U.S. Provisional Application Ser. No. 61/030,957, filed Feb. 23, 2008, the contents of which is incorporated by reference herein in its entirety.

TECHNICAL FIELD OF THE INVENTION

The present invention relates in general to the field of tool holders, and in particular, an apparatus for securing and holding tools of various sizes in an easily accessible and customizable manner.

BACKGROUND OF THE INVENTION

Recently, there has been a growing desire throughout industry and do-it-yourselfers alike for an apparatus incorporating a method that allows for the more efficient storage and retrieval of tools. Until now, traditional tool holders satisfied end users by including predefined spaces in which individualized tools could either be snapped into or removed from, one at a time. However when multiple tools of unrelated dimensions need immediate containment, modern tool holders are disappointing.

Today, common tool holders, which need not account for gravity to perform, do so by providing compartments fitted for individualized tools, often marketed in carrying case form for such tools. While generalized tool holders can suffice, when immediate controlled storage and release of multiple tools becomes imminent, such devices neglect expediency. Moreover, though such holders might serve as decent tool restraints, their efficacy often suffers in environments of high portability due to continual dropping.

As a consequence of the foregoing, a longstanding need exists among users for a method and apparatus that allows for the quick, simple, and effective storage and retrieval of tools not subject to dimensional prerequisites.

SUMMARY OF THE INVENTION

In accordance with the present invention, an apparatus and method are provided to allow for the more efficient storage and retrieval of tools. In one embodiment of the present invention a magnetic tool organizer includes In one embodiment, the present invention includes a magnetic tool organizer having a base having a plurality of spaced apart body apertures of a size and shape for accommodating at least one surface of a tool, said apertures organized in an array according to an outline of at least one surface of each said tool; and one or more spacers positioned between the apertures, wherein at least every other spacer comprises a magnet for holding a tool within the aperture. In one aspect, the apertures are circular, slots, rectangular, diagonal, square, oval, oblong, spherical, cylindrical triangular or polygonal. In one aspect, the organizer includes a magnet disposed in the base which may also have one or more organizer attachments, therein the organizer attachments are selected from hooks, slots, rails, pins, screws, or magnets. In another aspect, the apertures are molded to hold tools selected from wrenches, screwdrivers, sockets, scissors, saws, blades, hand tools, power tools or combinations thereof. In another aspect, each of the spacers includes a magnet and may be shaped and sized to facilitate placement and removal of the tool. In another aspect, magnetic tool organizer the base includes indicia that facilitate the placement of the correct tool into the correct aperture. Examples of magnets for use with the present invention include: neodymium, alnico, ceramic and/or ferrite magnet(s). In yet another aspect, the magnet poles alternate between magnets of adjacent or alternate spacers.

Another embodiment of the present invention is a method of holding a ferrous object by providing a first body member having a plurality of spaced apart body apertures of a size and shape for accommodating at least one surface of a tool, said apertures organized in an array according to an outline of at least one surface of each said tool; and providing one or more spacers positioned between the apertures, wherein at least every other spacer comprises a magnet for holding a tool. In one aspect, the apertures are circular, slots, rectangular, diagonal, square, oval, oblong, spherical, cylindrical triangular or polygonal. In one aspect, the organizer includes a magnet disposed in the base which may also have one or more organizer attachments, therein the organizer attachments are selected from hooks, slots, rails, pins, screws, or magnets. In another aspect, the apertures are molded to hold tools selected from wrenches, screwdrivers, sockets, scissors, saws, blades, hand tools, power tools or combinations thereof. In another aspect, each of the spacers includes a magnet and may be shaped and sized to facilitate placement and removal of the tool. In another aspect, magnetic tool organizer the base includes indicia that facilitate the placement of the correct tool into the correct aperture. Examples of magnets for use with the present invention include: neodymium, alnico, ceramic and/or ferrite magnet(s). In yet another aspect, the magnet poles alternate between magnets of adjacent or alternate spacers.

Yet another embodiment of the present invention is a magnetic tool organizer that includes a base comprising two or more blocks with an aperture formed between the blocks, wherein the aperture has a size and shape for accommodating at least tool, wherein at least one of the blocks comprises a magnet for holding a tool within the aperture. In one aspect, the apertures are circular, slots, rectangular, diagonal, square, oval, oblong, spherical, cylindrical triangular or polygonal. In one aspect, the organizer includes a magnet disposed in the base which may also have one or more organizer attachments, therein the organizer attachments are selected from hooks, slots, rails, pins, screws, or magnets. In another aspect, the apertures are molded to hold tools selected from wrenches, screwdrivers, sockets, scissors, saws, blades, hand tools, power tools or combinations thereof. In another aspect, each of the spacers includes a magnet and may be shaped and sized to facilitate placement and removal of the tool. In another aspect, magnetic tool organizer the base includes indicia that facilitate the placement of the correct tool into the correct aperture. Examples of magnets for use with the present invention include: neodymium, alnico, ceramic and/or ferrite magnet(s). In yet another aspect, the magnet poles alternate between magnets of adjacent or alternate spacers.

BRIEF DESCRIPTION OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1:
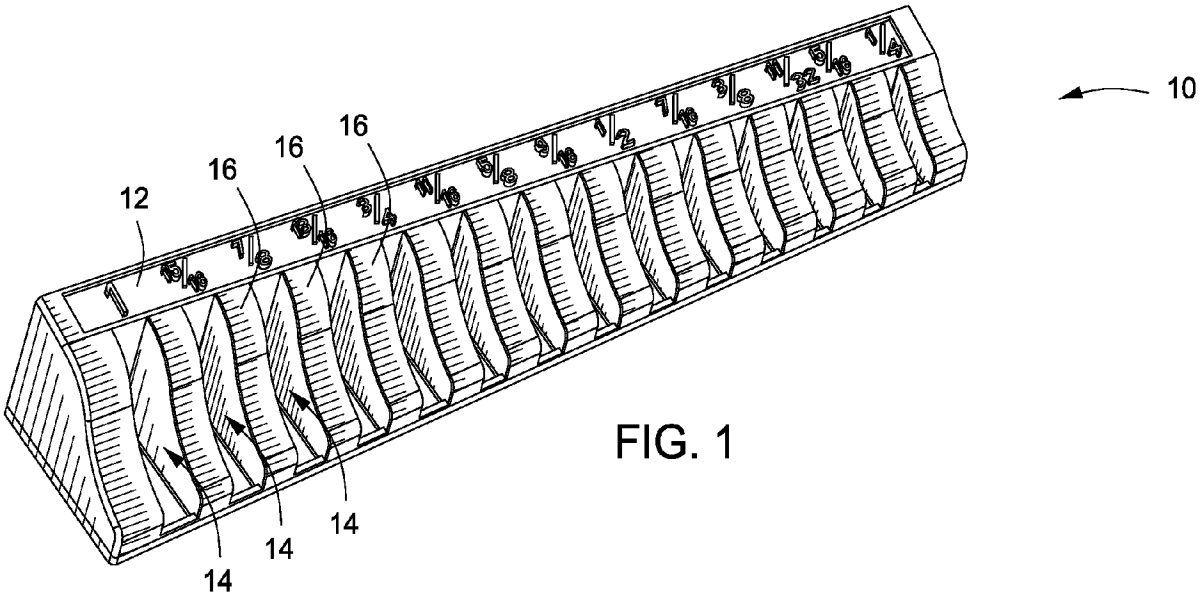
FIG. 1 illustrates one embodiment of the magnetic tool organizer of the present invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

The tools and tool holder of the present invention may be made from a wide variety of materials that may include, e.g., metallic or non-metallic or magnetic or non-magnetic or elastomeric or non-elastomeric or malleable or non-malleable or the one or more second restraints are metallic or non-metallic or magnetic or non-magnetic or elastomeric or non-elastomeric or malleable or non-malleable. Also, the present invention may be made such that the base is metallic or non-metallic or magnetic or non-magnetic or elastomeric or non-elastomeric or malleable or non-malleable. Examples of materials include metals, plastics, polymers, wood, alloys, composites and the like. The metals may be made from one or more metals, such as steel, stainless steel, aluminum, titanium, nickel, magnesium, or any other structural metal. Examples of plastics or polymers may include: nylon, polyethylene (PE), polypropylene (PP), polyester (PE), polytetraflouroethylene (PTFE), acrylonitrile butadiene styrene (ABS), polyvinylchloride (PVC), or polycarbonate, for example, GE's Lexan® polycarbonate, and combinations thereof, among other plastics. The tool restraint taught herein may be molded, sintered, machined and/or combinations thereof to form the required pieces to assemble the tool restraint components. Resilient pads may be made from any resilient material, for example, one of the plastics discussed above or from an elastomeric material, e.g., one or more of natural rubber, neoprene, ethylene-propylene rubber (EDM/EPDM), urethane, polyurethane, styrene-butadiene rubber (SBR), isoprene rubber (IR), butadiene rubber (BR); room-temperature vulcanizing (RTV) silicone rubber, and combinations thereof or their equivalent.

The present invention may also include magnetic surfaces that help to restrain the tools. For example, a wide variety of permanent magnets may be used with the present invention such as rare earth magnets, ceramic magnets, alnico magnets, which may be rigid, semi-rigid and flexible magnets. Flexible magnets are made by impregnating a flexible material such as neoprene rubber, vinyl, nitrile, nylon or a plastic with a material such as iron flakes having magnetic characteristics and will find use with the present invention.

FIG. 1 illustrates a magnetic tool organizer 10 that includes a base 12 having a plurality of spaced apart body apertures 14 of a size and shape for accommodating at least one surface of a tool, said apertures organized in an array according to an outline of at least one surface of a tool that is inserted into the aperture 14. One or more spacers 16 are positioned between the apertures 14, wherein at least every other spacer comprises a magnet for holding a tool (not depicted in this view). The magnetic tool organizer 10 may have the apertures 14 that may be circular, slots, rectangular, diagonal, square, oval, oblong, spherical, cylindrical triangular or polygonal. The base 12 is depicted with one or more indicia to help a user organize the tools based on shape, size, width, length or other indicia.

Figure 2:
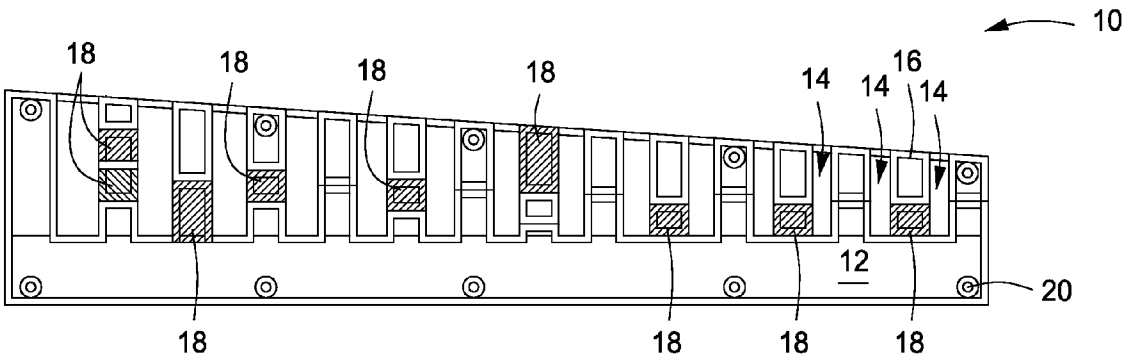
FIG. 2 illustrates a bottom, cross-section view of the magnetic tool organizer of the present invention.

FIG. 2 illustrates a bottom, cross-section view of the magnetic tool organizer 10 of the present invention. The view of FIG. 2 shows various embodiments of the internal positioning of the magnets 18, apertures and spacers that may be used alone, or in combination to holding tool within the apertures. The base 12 is shown with a plurality of spaced apart body apertures 14 of a size and shape for accommodating at least one surface of a tool. The spacers 16 are depicted having various lengths, widths and thicknesses and include therewith one or more magnets 18 that may be positioned at either end, within or in combinations within the spacer 16. The spacer 16 may be formed or molded into or to form the tool holder 10, however, the spacers 16 may be attached (permanently or not) to the base 12 to form the apertures 16. The apertures 16 may also vary in width, depth, thickness and shape in order to accommodate a tool. The aperture 14 may be circular, slots, rectangular, diagonal, square, oval, oblong, spherical, cylindrical triangular or polygonal. In certain embodiment, the magnets 18 may be positioned in every other spacer 16, or may be positioned in adjacent spacers, also as depicted in FIG. 2. In this bottom view positions for pins or screws 20 are depicted.

Figure 3:
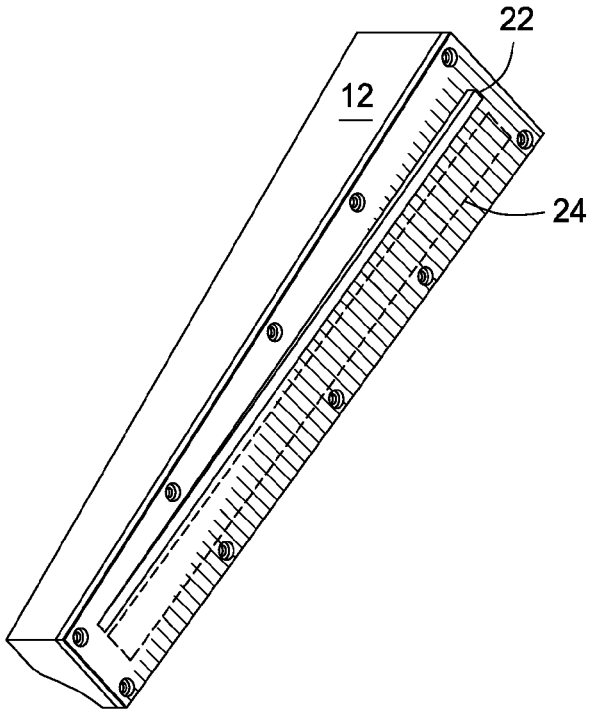
FIG. 3 depicts an isometric view of the base of the magnetic tool organizer.

FIG. 3 illustrates an isometric bottom view of the tool holder 10. In this figure a rail 22 is depicted that may be used to attach the tool holder 10 to a tool organizer (not depicted). In another embodiment of an attachment mechanism, the figure also shows a magnet 14 that is depicted as being internal to the tool holder 10. The skilled artisan will recognize that these and other mechanisms for attachment of the tool holder 10 to a tool organizer may be used alone or in combination. For example, the base 12 may include hooks or pegs for attaching to a peg board, slots or rails (and vice versa), magnets (internal and external), suction cups, lips, screws, rivets or other mechanical attachment points (internal and external) may be used to attach (permanently, semi-permanently or removably) the tool holder to a tool organizer that may be horizontal, vertical or diagonal. The tool holder 10 may be fitted into a tray (permanently, semi-permanently or removably) and include indicia to permit the user to better and quickly organize the tools.

Figure 4:
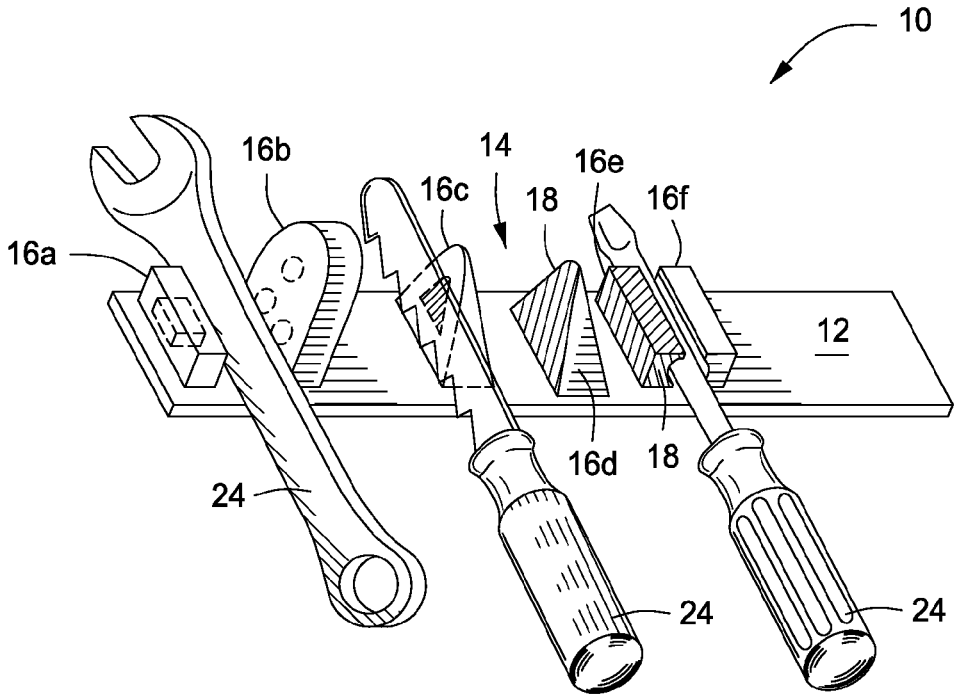
FIG. 4 is an isometric view of another embodiment of the magnetic tool organizer of the present invention.

FIG. 4 illustrates another embodiment of the present invention in which the spacers 16 are in the forms of blocks of different shapes that may be able to hold different tools 24. The base 12 may be ferrous or magnetic thereby allowing spacers 16 to be movable. In other embodiments, the base 12 may have a slot or slots that permit the user to add, move or remove spacers, change their spacing, etc. The magnets 18 are shown in a variety of configurations, including rectangular (16*a*), spherical (16*b*), planar (16*c*), as a coating (16*d*), as the entire spacer (16*e*)or not in the spacer (16*e*)

The tools that may be held using the present invention include, but are not limited to hand tools, mechanic's tools, wrenches, screwdrivers, Allen wrenches, pliers, saws, knives, hammers, bits, taps, threading tools, augers, files, rasps, punches, chisels, snips, bolt-cutters, extensions (e.g., socket or bit extensions), power tool accessories and ratchets. The tools may be parts of sets of common tools, or combinations of different types of tools.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

In the claims, all transitional phrases such as "comprising," "including," "carrying," "having," "containing," "involving," and the like are to be understood to be open-ended, i.e., to mean including but not limited to. Only the transitional phrases "consisting of" and "consisting essentially of," respectively, shall be closed or semi-closed transitional phrases.

All of the materials and/or methods disclosed and claimed herein can be made and executed without undue experimentation in light of the present disclosure. All such similar substitutes and modifications apparent to those skilled in the art are deemed to be within the spirit, scope and concept of the invention as defined by the appended claims.

What is claimed is:

1. A magnetic tool organizer comprising: a base having a plurality of spaced apart body apertures of a size and shape for accommodating at least one surface of a tool, said apertures organized in an array according to an outline of at least one surface of each said tool; and one or more movable spacers positioned between the apertures, wherein at least every other movable spacer comprises a magnet for holding a tool within the aperture.

2. The magnetic tool organizer of claim 1, wherein the apertures are circular, slots, rectangular, diagonal, square, oval, oblong, spherical, cylindrical triangular or polygonal.

3. The magnetic tool organizer of claim 1, wherein the base comprises one or more organizer attachments, therein the organizer attachments are selected from hooks, slots, rails, pins, screws, or magnets.

4. The magnetic tool organizer of claim 1, wherein the apertures are molded to hold tools selected from wrenches, screwdrivers, sockets, scissors, saws, blades, hand tools, power tools or combinations thereof.

5. The magnetic tool organizer of claim 1, wherein each of the movable spacers comprise a magnet and are shaped and sized to facilitate placement and removal of the tool.

6. The magnetic tool organizer of claim 1, wherein the base comprises indicia that facilitate the placement of the correct tool into the correct aperture.

7. The magnetic tool organizer of claim 1, wherein the magnets are neodymium, an alnico, a ceramic or a ferrite magnet.

8. The magnetic tool organizer of claim 1, wherein the magnet poles alternate between magnets of adjacent, alternate or both adjacent and alternate spacers.

9. A method of holding a ferrous object comprising: providing a first body member having a plurality of spaced apart body apertures of a size and shape for accommodating at least one surface of a tool, said apertures organized in an array according to an outline of at least one surface of each said tool; and providing one or more movable spacers positioned between the apertures, wherein at least every other movable spacer comprises a magnet for holding a tool.

10. The method of claim 9, further comprising magnets at each movable spacer.

11. The method of claim 9, wherein the apertures are circular, slots, rectangular, diagonal, square, oval, oblong, spherical, cylindrical triangular or polygonal.

12. The method of claim 9, further comprising a magnet disposed on first body member further comprise a base that comprises one or more organizer attachments, therein the organizer attachments are selected from hooks, slots, rails, pins, screws, or magnets.

13. The method of claim 9, wherein each of the movable spacers comprise a magnet and are shaped and sized to facilitate placement and removal of the tool.

14. The method of claim 9, wherein the first body member, the second body member or both further comprise indicia that facilitate the placement of the correct tool into the correct aperture.

15. The method of claim 9, wherein the magnets are neodymium, an alnico, a ceramic or a ferrite magnet.

16. The method of claim 9, wherein the magnet poles alternate between adjacent magnets.

17. A magnetic tool organizer comprising: a base comprising two or more blocks with an aperture formed between the blocks, wherein the aperture has a size and shape for accommodating at least tool, wherein at least one of the blocks comprises a magnet for holding a tool within the aperture.

18. The magnetic tool organizer of claim 17, wherein the apertures are circular, slots, rectangular, diagonal, square, oval, oblong, spherical, cylindrical triangular or polygonal.

19. The magnetic tool organizer of claim 17, further comprising a magnet disposed in the base.

20. The magnetic tool organizer of claim 17, wherein the base further comprised one or more organizer attachments, therein the organizer attachments are selected from hooks, slots, rails, pins, screws, or magnets.

* * * * *